United States Patent [19]

Wilson et al.

[11] Patent Number: 4,703,598

[45] Date of Patent: Nov. 3, 1987

[54] COMBINED NOISE SEAL AND RETAINER FOR PANEL

[75] Inventors: Harold R. Wilson, Holland; Gary Ottenjan, Belmont; Gary Bischoff, Grand Haven, all of Mich.

[73] Assignee: Haworth, Inc., Holland, Mich.

[21] Appl. No.: 856,711

[22] Filed: Apr. 28, 1986

[51] Int. Cl.[4] ..... E04H 1/12

[52] U.S. Cl. ..... 52/238.1; 52/243.1; 52/397

[58] Field of Search ..... 52/397–403, 52/208, 209, 243.1, 238.1, 239, 240, 241; 49/413, 463

[56] References Cited

U.S. PATENT DOCUMENTS

| | | | |
|---|---|---|---|
| 2,877,511 | 3/1959 | Viola | 49/413 |
| 3,072,226 | 1/1963 | Harwood | 52/241 |
| 3,256,668 | 6/1966 | Downes | 52/242 |
| 3,381,438 | 5/1968 | Bohnsack | 52/241 |
| 3,438,166 | 4/1969 | Bakke | 52/209 |
| 4,042,004 | 8/1977 | Kwan | 49/413 |
| 4,233,781 | 11/1980 | Roe | 49/413 |

*Primary Examiner*—James L. Ridgill, Jr.
*Attorney, Agent, or Firm*—Flynn, Thiel, Boutell & Tanis

[57] ABSTRACT

A privacy wall for joining a floor and ceiling, which wall includes a lower panel projecting upwardly from the floor, and a privacy panel extending vertically between the ceiling and the upper edge of the lower panel. The privacy panel has upper and lower edges supported within retainers confined within recesses defined by support tracks. The upper and lower retainers are identical but reversely vertically oriented relative to the respective recesses. Each retainer includes a central base wall and pairs of first and second legs projecting outwardly in opposite directions to define first and second oppositely oriented channels which accommodate the edge of the privacy panel therein. The first legs are short and inclined inwardly so that the lower edge of the panel can be sealingly accommodated therebetween. The second legs are of greater length and have sideward flanges adjacent the ends thereof. The upper retainer is oriented with the second legs projecting downwardly, with the deflected second legs being sealingly engaged with opposite sides of the privacy panel.

2 Claims, 5 Drawing Figures

COMBINED NOISE SEAL AND RETAINER FOR PANEL

FIELD OF THE INVENTION

This invention relates to a retainer for the edge of a vertical panel, which retainer is effective for creating a seal against transmission of sound around the edge of the panel.

BACKGROUND OF THE INVENTION

Many large office spaces are divided into smaller offices by wall panels which are supported on and project upwardly from the floor, with such panels being spaced downwardly a substantial distance from the ceiling. Such panels hence define what is commonly referred to as an open-office system. Such system works highly satisfactorily in most environments but, in some situations, it is desirable to provide a higher degree of privacy, specifically for management-level personnel. In such situations, an additional system of panels is provided which mount on top of the wall panels and project upwardly for attachment to the ceiling. Such top panels, conventionally glass or plexiglass panels referred to as privacy panels, are generally secured by having their upper and lower edges positioned within channel-like retaining strips. These strips generally loosely confine the upper and lower edges of the privacy panels therein, and hence it has been observed that significant noise is transmitted around the edges of the panels. The desired privacy within the enclosed office space is thus not achieved. Further, it is typical to provide separate upper and lower retainers for engaging the respective upper and lower edges of the privacy panels. This is undesirable since two different retainers must be manufactured and maintained in inventory.

Accordingly, it is an object of this invention to provide an improved retainer which is suitable for use with privacy panels when creating a vertical wall structure so as to overcome the latter mentioned disadvantages.

More specifically, the present invention relates to an improved retainer strip which is configured to permit the same retainer strip to be utilized both along the upper and lower edges of the privacy panel merely by reversing the orientation of the retainer strip. At the same time, the improved retainer strip has been designed to create points of sealing engagement on opposite sides of the privacy panel, and on opposite sides of the track which supports the retainer, so as to greatly minimize the possible transmission of noise or sound around the edges of the privacy panel.

Other objects and purposes of the invention will be apparent to persons familiar with structures of this general type upon reading the following specification and inspecting the accompanying drawings.

Figure 1:
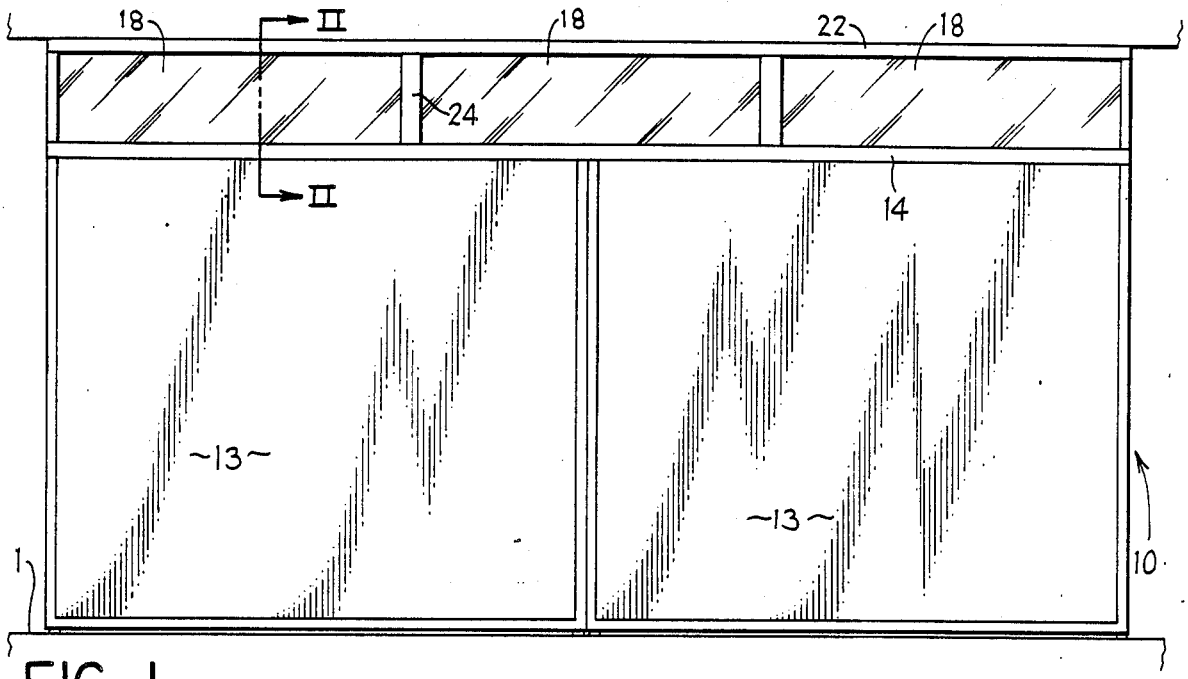
FIG. 1 an elevational view which diagrammatic illustrates a wall structure employing privacy panels.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the wall structure and designated parts thereof. Said terminology will include the words specifically mentioned, derivatives thereof, and words of similar import.

DETAILED DESCRIPTION

Figure 2:
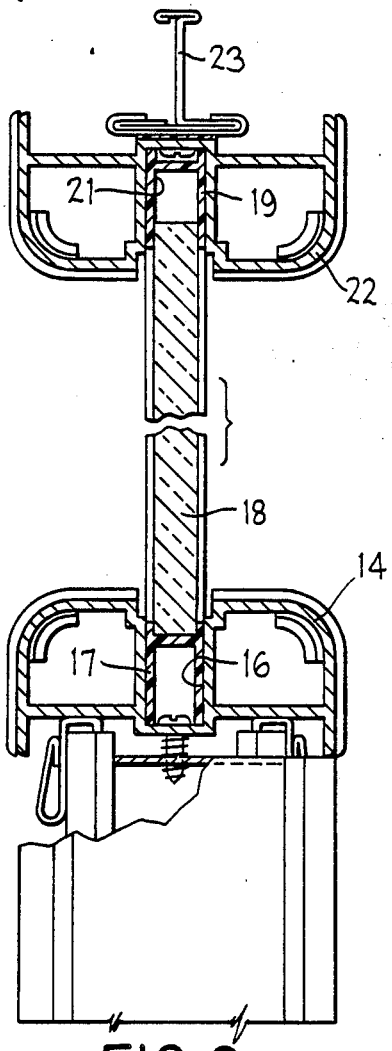
FIG. 2 is an enlarged cross-sectional view as taken substantially along line II—II in FIG. 1, this view illustrating the retainers solely diagrammatically.

Referring to FIGS. 1 and 2, there is illustrated a vertical wall arrangement 10 which is adapted to extend between a floor 11 and a ceiling 12, which vertical wall arrangement is intended to represent only one of several walls which cooperate to define a closed office.

The wall structure 10 includes conventional space-divider wall panels 13, several of which are connected in series to form a wall structure. These wall panels 13 are conventional and well known, and the structure and usage of same is explained in greater detail in U.S. Pat. No. 3,909,204. These panels 13 project upwardly from the floor but have a height which is significantly less than the room height, whereby the upper edges of the panels are spaced downwardly a significant distance below the ceiling. To create a privacy office, the wall panels 13 are provided with privacy panels 18 on the tops thereof which extend upwardly to the ceiling, as indicated by the wall arrangement 11.

For the above purpose, the upper edges of the wall panels 13 are provided with support tracks 14 extending therealong, and each support track defines therein an upwardly-opening channel-like recess 16. This recess 16 accommodates therein an insert or retainer strip 17 according to the present invention, and this retainer 17 in turn supportingly engages the lower horizontally extending edge of a privacy panel 18. This privacy panel typically comprises a sheetlike glass or plexiglass panel, and the upper edge thereof is accommodated within another retaining strip 19. This upper retainer 19 is similarly accommodated within a downwardly-opening channel-like recess 21 formed in an upper support track 22, the latter typically being fixedly secured, as by screws or the like, to a conventional T-mold 23 which is associated with most conventional drop ceilings.

The opposed vertical edges of adjacent privacy panels 18 are typically engaged within posts 24 which have a generally H-shaped cross section so as to slidably accommodate the opposed vertical edges of adjacent privacy panels.

The channel-like recesses 16 and 21 which accommodate the retainer strips therein are preferably identical and each is defined by a pair of opposed substantially parallel side walls 26, with the channel being closed at one end by means of an end wall 27 which extends perpendicularly between the side walls 26. The side walls 26 of the recess preferably extend vertically through a substantial extent so as to permit the retainer strip to be wholly vertically confined therein.

Figure 3:
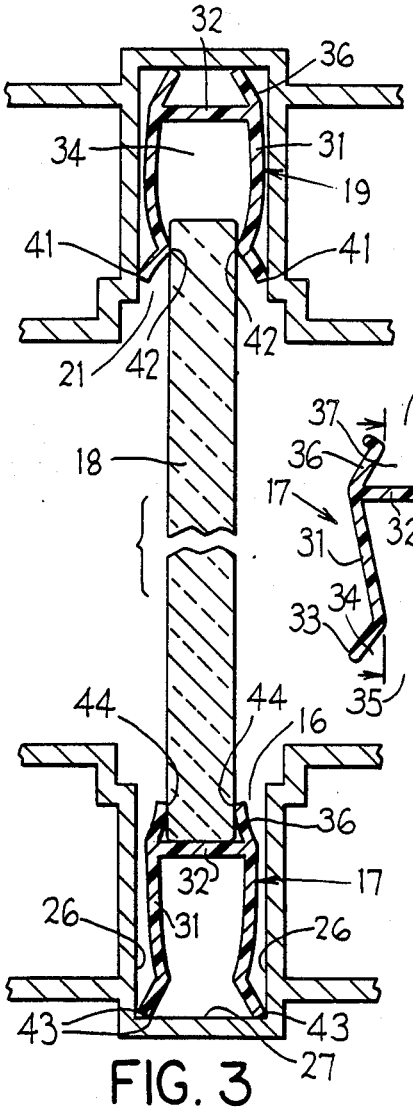
FIG. 3 is an enlarged fragmentary cross-sectional view similar to FIG. 2 but illustrating the geometry and structural cooperations created by the improved retainer of the present invention.

According to the present invention, the upper and lower retainer strips 19 and 17, respectively, are identical except that they are reversely vertically oriented relative to their respective recess. Hence, the following description of the retainer will make reference to FIG. 4, which figure illustrates the orientation when the retainer is disposed for engagement with the lower edge of the privacy panel, such as retainer 17 of FIG. 3.

Figure 4:
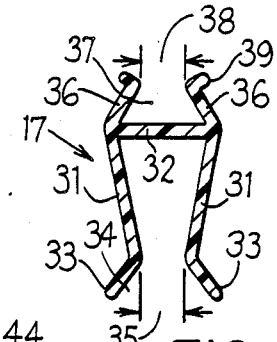
FIG. 4 is a cross-sectional view through the retainer when the latter is in a nondeformed condition.

The retainer strip 17 (or 19) as illustrated by FIG. 4 includes a pair of approximately parallel cantilevered legs 31 which are of substantial vertical extent and which, adjacent one end thereof, are joined together by a base wall 32 extending perpendicularly therebetween. The legs 31 hence project downwardly in a cantilevered fashion from the base wall and, adjacent their lower or outer free ends, are provided with flanges 33 which project downwardly but outwardly away from the respective legs 31. These flanges 33 define a flared mouth or opening which opens inwardly into the channel 34 defined between the parallel legs 31. This channel 34 has a width, as measured between the inner surfaces of the legs 31 adjacent the base wall 32, which is normally slightly greater than the thickness of the privacy panel 18. Similarly, the perpendicular spacing or width between the outer surfaces of legs 31 is normally slightly less than the width of the recesses 21 and 16 as defined between the opposed side walls 26 thereof.

As best illustrated by FIG. 4, the legs 31 when the retainer strip is in a nondeformed condition preferably project outwardly in a slightly inwardly converging relationship with one another so that the opening 35 as defined between the outer or free ends of the legs 31 is hence slightly smaller than the normal width of the channel 34, and in fact this opening 35 is slightly less than the thickness of the panel 18. Similarly, the maximum width across the flanges 33 adjacent the free or outer ends thereof is preferably close to but slightly less than the width of the recesses 21 and 16 as defined between the opposed side walls 26 thereof.

The insert or retainer strip 17 (or 19) also has a further pair of cantilevered legs 36 which in effect constitute extensions of the legs 31 but which project in the opposite direction from the base wall 32. These latter legs 36 are initially preformed so that they slope toward one another as they project towards their outer ends, although the outer ends of the legs 36 do not contact one another but rather are spaced apart by means of a mouth 38 which opens inwardly into the channel 37 defined between the legs. This channel 37, at the base thereof, has a width which substantially corresponds to the width of the channel 34. However, the width of the mouth 38 is normally slightly less than the thickness of the privacy panel 18.

Legs 31, adjacent their outer ends, are also provided with flanges 39 which project upwardly but outwardly away from the respective leg, which flanges hence define a flared opening which communicates with the mouth 38. The maximum width across these flanges 39, however, is less than the width of the recesses 21 and 16 as defined between the opposed side walls 26 thereof.

In addition, the legs 36 project outwardly away from the base wall 32 by a distance which is only a small fraction of the projecting length of the legs 31. For example, the legs 36 normally project outwardly by a distance which is no more than about one-half the length of the legs 31, and preferably the legs 36 project outwardly through a distance which is between one-fourth and one-third the length of the legs 31.

The retainer strip 17 (or 19) is preferably extruded of a plastics material in the form of an elongated strip so that a single retainer strip is cut to length so as to extend completely along the full length of the respective edge of the privacy panel. By extruding the retainer strip from a plastics material, the retainer strip hence possesses a limited amount of resiliency so as to permit the opposed pairs of legs 31 and 36 to be suitably resiliently deformed, with the legs themselves being able to achieve a snug sealing engagement with the members which they contact, such as the privacy panel and the walls of the support track.

For supportingly engaging the lower edge of the privacy panel, the retainer strip 17 is positioned and oriented within the recess 16 such that the long legs 31 are oriented downwardly. When the retainer strip 17 is moved downwardly so as to seat against the end wall 27, the tips of the flanges 33 will effectively sealingly engage either the side walls 26 or the end wall 27 adjacent the corners thereof, this sealing engagement occurring at the seal points 43.

Thereafter, the lower edge of the privacy panel 18 is inserted between the legs 36, which insertion due to flanges 39 causes the legs 36 to be resiliently deflected outwardly so as to accommodate the width of the panel, whereupon the tips of the legs 36 will sealingly engage the opposite sides of the privacy panel 18, such as at the seal points 44. In this manner, the seal points 44 prevent noise from being transmitted between the edge of the privacy panel and the retainer, and the seal points 43 will prevent noise from being transmitted around the outside of the retainer.

With respect to the upper retainer strip 19, it is identical to the strip 17 but is reversely oriented for insertion into the recess 19. For example, the short legs 36 are first inserted into the recess 21 until the free ends thereof effectively abut the end wall 27. The upper edge of the privacy panel can be inserted into the channel 34 between the legs 31, which legs 31 adjacent the free ends thereof will resiliently deform outwardly sufficiently to snugly accommodate the edge of the privacy panel 18 therebetween, which outward deformation of legs 31 also caused the free ends of flanges 33 to contact the sidewalls 26. There is thus hence created seal points 42 where the legs 31 contact the opposite sides of the privacy panel, and seal points 41 where the tips of the flanges 33 contact the side walls 26. Hence, these seal points 41 and 42 prevent transmission of noise both between the edge of the privacy panel and the retainer, and externally around the retainer.

To facilitate the installation of the privacy panel, the upper retainer 19 has the deep channel 34 oriented downwardly so that the upper edge of the privacy panel 18 can be initially slidably inserted therein and then moved upwardly into the channel 34 through a substantial extent, following which the privacy panel can then be slidably moved downwardly so that the lower edge thereof is inserted into the channel 37 between the legs 36 of the lower insert 17, with the lower edge of the privacy panel resting on the base wall 32 of the lower insert 17 so as to supportingly bear the weight of the privacy panel.

If desired or necessary to facilitate installation of the upper retainer strip 19 into its channel 21, the retainer strip can be initially positioned over the upper edge of the panel 18, with the panel having the retainer strip already positioned thereon then being slidably moved upwardly into the channel 21.

Figure 5:
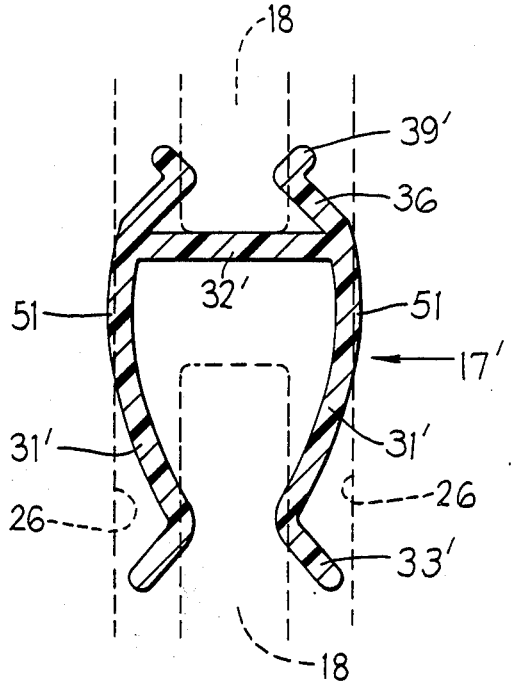
FIG. 5 is a cross-sectional view through a second and preferred embodiment of the retainer when the latter is in a nondeformed condition.

Considering now FIG. 5, there is illustrated a modified configuration of the retainer strip which constitutes a preferred embodiment.

The modified retainer strip 17' of FIG. 5 is again of a one-piece construction formed of a stiff plastic material, with the retainer having a generally H-shaped configuration similar to that of FIG. 4. In fact, the retainer 17' of FIG. 5 possesses the same basic structural and functional features as retainer 17 of FIG. 4 and hence the same reference numerals are used to designate same except with the addition of a prime (') thereto. This modified retainer strip 17', however, has the legs 31' thereof provided with a slight outward curvature located intermediate the ends thereof, this outward curvature as appearing at 51 hence causing the legs to have a maximum width thereacross which slightly exceeds the maximum width of the channel 16 or 21 as measured between the sidewalls 26 thereof. Hence, when the retainer strip 17' is positioned within the channel, the configuration of the retainer strip will permit it to be automatically fed into the open end of the respective channel, whereupon the curvature of the bowed or widened portions 51 of the legs will automatically feed the strip 17' between the sidewalls 26 and cause a slight resilient flattening of the sidewalls at the portion 51. Hence, this not only provides a pair of sealing points where these widened or flared portions 51 contact the sidewalls 26, but this also provides a sufficient frictional engagement between the retainer strip and the sidewalls so as to hold the retainer strip in position, such as when the retainer strip is positioned into the upper channel. When the panel 18 is inserted between the legs 31', they are again resiliently deflected outwardly and in effect create seal points at the outer ends of the legs where they engage the panel 18, and create additional seal points where the tips of the flanges also contact the sidewalls 26.

The retainer strip of the present invention is preferably constructed of a rigid polyvinylchloride (pvc) plastic.

Hence, the improved retainer strip of the present invention not only greatly facilitates installation, and additionally permits use of the same retainer along both the top and bottom edges of the privacy panel, but it also provides a desirable double seal both along the inside and outside of the retainer strip so as to greatly minimize noise transmission around the privacy panel.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a privacy-type vertical wall arrangement extending between a ceiling and a floor, said wall arrangement including a space-divider panel projecting upwardly from the floor to an elevation spaced downwardly a substantial distance from the ceiling, and a privacy panel means extending vertically between the upper edge of said space-divider panel and said ceiling, said privacy panel means including a lower horizontally-elongated support track fixed to the upper edge of the space-divider panel and an upper horizontally-elongated support track fixed to said ceiling, the lower support track defining therein a lower horizontally-elongated upwardly-opening channellike recess therein, said upper support track defining an upper horizontally-elongated downwardly-opening channellike recess therein, said upper recess being vertically aligned above said lower recess, upper and lower horizontally-elongated striplike retainers respectively positioned within the upper and lower recesses, and a privacy panel extending vertically between and having the upper and lower edges thereof respectively retained within the upper and lower retainers, comprising the improvement wherein:

said upper and lower retainers are identical in cross section;

said upper and lower recesses being defined between substantially parallel side walls which are spaced a predetermined distance apart, said side walls being joined by an end wall which is located at an end of the recess opposite the open end thereof;

said retainer when viewed in cross section having as pair of approximately parallel elongated cantilevered first legs which have one end thereof rigidly joined together by a base wall, said first legs at the other ends thereof being free so that said legs define a deep channel therebetween which is closed at its inner end by said base wall;

said retainer also having a pair of cantilevered second legs which are joined to the one end of said first legs and project in the opposite direction therefrom so that said second legs project in the opposite direction away from said base wall, said second legs being of short extent and projecting outwardly so as to terminate in free ends, said second legs defining a shallow channel therebetween which is closed at its inner end by said base wall;

said retainer being constructed of a plastics material so that said first and second legs can be elastically deflected through a limited extent;

a flange integrally associated with each said first and second legs adjacent the free end thereof, each said latter flange projecting in a sideward outward direction relative to the respective leg so as to terminate in a free edge, whereby the flanges associated with said first and second legs define flared mouths to facilitate insertion of the privacy panel into the respective channel;

the opposed pairs of first and second legs at the outer ends thereof, where they join to the respective flanges, defining mouth openings having widths which are slightly less than the widths of the respective channels and which are also slightly less than the width of the privacy panel;

said first legs at a location intermediate the ends thereof being provided wiht a slightly outwardly bowed portion, the transverse width of the retainer across the bowed portions being slightly greater than the width of the recess so that the bowed portions slidably and sealingly contact the sidewalls of the recess and cause a slight inward resilient deflection of the first legs toward one another;

said upper retainer being disposed within said upper recess so that the second legs are disposed uppermost, the first legs of the upper retainer being directed downwardly so that the deep channel opens downwardly through the open end of the upper recess, said first legs being resiliently deflected for sealing contact with the sides walls of said upper recess, and said first legs adjacent the free ends thereof being disposed in sealing contact with opposite sides of the privacy panel adjacent the upper edge thereof, the upper edge of said privacy panel projecting into said deep channel but being spaced downwardly a substantial distance from the base wall of the upper retainer; and said lower retainer being disposed within the lower recess such that said first legs project downwardly, said first legs being in sealing contact with said side walls and having the free edges of the flanges supportingly engaged with the base wall of said lower recess, the second legs of said lower retainer being slightly resiliently deflected outwardly due to the lower edge portion of the privacy panel being inserted therebetween whereby the free ends of the second legs sealingly engage the opposite sides of the privacy panel, and the lower edge of the privacy panel being supportingly engaged on the base wall of the lower retainer.

2. An arrangement according to claim 1, wherein said second legs project outwardly from said base wall through a distance which is no more than one-third the length of said first legs.

* * * * *